US008953983B2

(12) United States Patent
Iikura et al.

(10) Patent No.: US 8,953,983 B2
(45) Date of Patent: Feb. 10, 2015

(54) IMAGE FORMING APPARATUS AND TRANSPORT DEVICE

(71) Applicant: Fuji Xerox Co., Ltd., Tokyo (JP)

(72) Inventors: Kazuaki Iikura, Kanagawa (JP); Yasuhiro Warita, Kanagawa (JP); Satoshi Miyawaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 25 days.

(21) Appl. No.: 13/758,523

(22) Filed: Feb. 4, 2013

(65) Prior Publication Data

US 2014/0064789 A1 Mar. 6, 2014

(30) Foreign Application Priority Data

Sep. 4, 2012 (JP) ..... 2012-193649

(51) Int. Cl.
*G03G 15/00* (2006.01)
*G03G 15/16* (2006.01)
*G03G 21/16* (2006.01)

(52) U.S. Cl.
CPC ..... *G03G 21/1695* (2013.01)
USPC ..... 399/124; 399/316

(58) Field of Classification Search
USPC ..... 399/124, 316, 317, 388, 390, 406
See application file for complete search history.

(56) References Cited

U.S. PATENT DOCUMENTS

| | | | | |
|---|---|---|---|---|
| 4,882,606 | A * | 11/1989 | Deguchi | 399/316 |
| 2006/0180973 | A1* | 8/2006 | Igarashi | 271/4.01 |
| 2007/0048010 | A1* | 3/2007 | Nakano | 399/121 |
| 2007/0231032 | A1* | 10/2007 | Matsuno | 399/388 |
| 2007/0280750 | A1* | 12/2007 | Kurosu et al. | 399/316 |
| 2009/0226210 | A1 | 9/2009 | Hayakawa et al. | |
| 2010/0104331 | A1* | 4/2010 | Matsuno | 399/316 |

FOREIGN PATENT DOCUMENTS

JP A 2009-210903 9/2009

* cited by examiner

*Primary Examiner* — Sophia S Chen
(74) *Attorney, Agent, or Firm* — Oliff PLC

(57) ABSTRACT

Disclosed is an image forming apparatus including an image forming apparatus member, a toner image forming unit including a housing that accommodates at least one of a toner image retainer to retain a toner image and a toner retainer to supply a toner to the toner image retainer, and a recording medium transport unit including a transport belt, having an endless shape, that is openably and closably mounted to the image forming apparatus member and transports a recording medium with being wound between a pair of support rollers provided along a transport direction of the recording medium, and a regulation member that faces the transport belt to regulate a posture of the recording medium, wherein when the recording medium transport unit is closed with respect to the image forming apparatus member, the regulation member is positioned to come into contact with the housing.

7 Claims, 7 Drawing Sheets

CROSS-SECTION A-A

IMAGE FORMING APPARATUS AND TRANSPORT DEVICE

CROSS-REFERENCE TO RELATED APPLICATIONS

This application is based on and claims priority under 35 USC 119 from Japanese Patent Application No. 2012-193649 filed on Sep. 4, 2012.

BACKGROUND

Technical Field

The present invention relates to an image forming apparatus and a transport device.

SUMMARY

According to an aspect of the invention, there is provided an image forming apparatus including an image forming apparatus member, a toner image forming unit including a housing that accommodates at least one of a toner image retainer to retain a toner image and a toner retainer to supply a toner to the toner image retainer, and a recording medium transport unit including a transport belt, having an endless shape, that is openably and closably mounted to the image forming apparatus member and transports a recording medium, with being wound between a pair of support rollers provided along a transport direction of the recording medium, and a regulation member that faces the transport belt to regulate a posture of the recording medium, wherein when the recording medium transport unit is closed with respect to the image forming apparatus member, the regulation member is positioned to come into contact with the housing.

BRIEF DESCRIPTION OF THE DRAWINGS

Exemplary embodiments of the present invention will be described in detail based on the following figures, wherein.

DETAILED DESCRIPTION

Exemplary embodiments and specific examples of the invention will be described in more detail below with reference to the drawings, but the invention is not limited thereto.

It should be noted that the drawings are schematic only and the ratios of each dimension or the like are different from those actually used, in the explanation using the following drawings. Components other than those required to facilitate understanding of the description are omitted as appropriate.

In order to facilitate understanding of the following description, the forward and rearward direction refers to an X-axis direction, the left and right direction refers to a Y-axis direction, and the vertical direction refers to a Z-axis direction.

(1) Overall Configuration and Operation of Image Forming Apparatus

Figure 1:
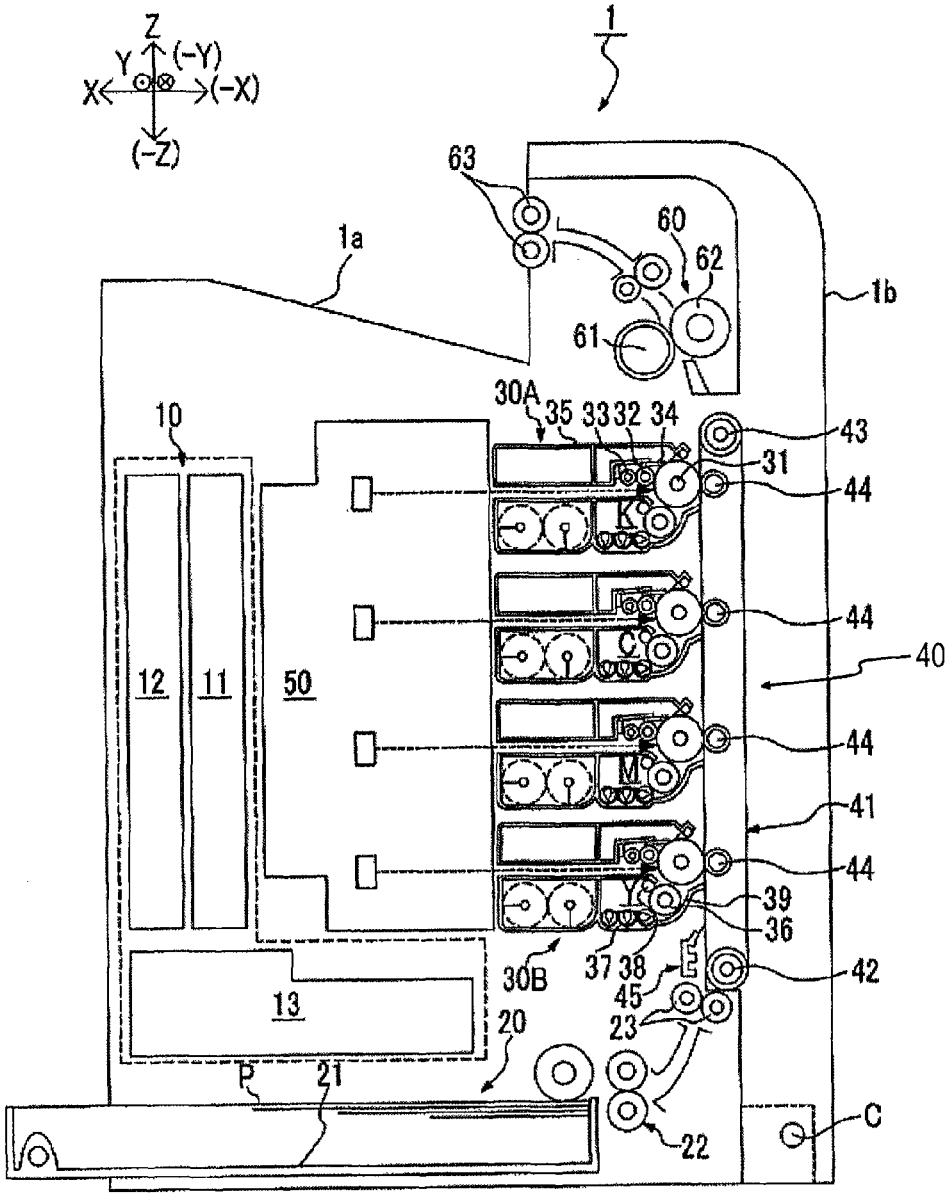
FIG. 1 is a schematic cross-sectional view illustrating an inside configuration of an image forming apparatus.

FIG. 1 is a schematic cross-sectional view illustrating an inside configuration of an image forming apparatus 1 according to an exemplary embodiment.

Hereinafter, the overall configuration and the operation of the image forming apparatus 1 will be described with reference to the drawings.

The image forming apparatus 1 includes a control device 10, a paper feed device 20, image forming units 30, a paper transport device 40, an exposure device 50, and a fixing device 60. An upper surface (Z direction) of the image forming apparatus 1 is formed with a discharge tray 1*a* to discharge and accommodate paper on which an image is recorded.

The control device 10 has a controller 11 to control the operation of the image forming apparatus 1, an image processing portion 12 of which the operation is controlled by the controller 11, a power supply 13, etc. The power supply 13 applies a bias voltage to charging rollers 32, development rollers 36, transfer rollers 44, etc. which are described later.

The image processing portion 12 converts printed information input from an external information transmitting device (for example, a personal computer or the like) into image information for latent image formation to output a driving signal to the exposure device 50 at a preset timing.

The paper feed device 20 is provided on the bottom of the image forming apparatus 1. The paper feed device 20 includes a paper loading plate 21, and paper P as multiple recording media is loaded onto an upper surface of the paper loading plate 21. The paper P, which is loaded onto the paper loading plate 21 and has a position in the width direction decided by a regulation plate (not shown), is drawn one by one from above in the forward direction (−X direction) by a paper drawing portion 22, and is then transported up to a nip portion of a pair of resist rollers 23.

Each of the image forming units 30 includes a photoconductor unit 30A and a development unit 30B which are integral with each other as an exchange unit and detachably mounted to the image forming apparatus 1.

The photoconductor unit 30A includes a photoconductor drum 31, a charging roller 32, a cleaning roller 33 to clean a surface of the charging roller 32, a cleaning blade 34, and a drum housing 35.

The development unit 30B has a development housing 39 within which developer is accommodated. The development housing 39 is provided therein with a development roller 36 disposed to face the photoconductor drum 31, and an auger 37 which is arranged obliquely downward to the back surface side of the development roller 36 and agitates and transports the developer to the development roller 36 side. The development roller 36 is closely provided with a layer regulating member 38 to regulate a layer thickness of the developer.

In the image forming unit 30, the photoconductor unit 30A and the development unit 30B as the exchange unit may be provided and detachably mounted to the image forming apparatus 1 respectively.

A surface of the rotating photoconductor drum 31 is electrically charged by the charging roller 32 and formed with electrostatic latent images by latent image forming light emitted from the exposure device 50. The electrostatic latent images formed on the rotating photoconductor drum 31 are respectively developed as yellow (Y), magenta (M), cyan (C), and black (K) toner images by the development roller 36.

The residual toner on the surface of the photoconductor drum 31 is removed by the cleaning blade 34 and collected in a waste toner accommodating portion provided in the drum housing 35. The surface of the photoconductor drum 31 is electrically charged again by the charging roller 32.

Meanwhile, the residue, which adheres to the charging roller 32 without being removed by the cleaning blade 34, comes into contact with the charging roller 32 to be captured and accumulated on a surface of the rotating cleaning roller 33.

The paper transport device 40 is used as a transfer unit and includes a transport belt 41 which circulates along a paper transport path, a pair of tension rollers 42 and 43 which span the transport belt 41 in an annular shape (endless shape), transfer rollers 44, and a paper posture regulating member 45.

In the paper transport device 40, the above-mentioned respective members are integral with each other as the transfer unit and detachably mounted to the image forming apparatus 1.

The transport belt 41 is made of a belt material (rubber or resin) which may electrostatically adsorb paper, and is laid across the pair of tension rollers 42 and 43 in an annular shape (endless shape).

In the pair of tension rollers 42 and 43, the tension roller 42 of the lower side (−Z direction) is used as a driving roller to drive the transport belt 41, whereas the tension roller 43 of the upper side (Z direction) is used as a driven roller.

Each of the transfer rollers 44 is arranged on the back surface side of the transport belt 41 which corresponds to the photoconductor drum 31 of each image forming unit 30.

A predetermined transfer bias is properly applied between each photoconductor drum 31 and the associated transfer roller 44 by the power supply 13. Consequently, the paper P is closely attached between the photoconductor drum 31 and the transport belt 41 and each toner image on the photoconductor drum 31 is transferred onto the paper P.

The fixing device 60 is constituted by a heating roller 61 and a pressure roller 62, and is formed with a nip portion (fixing region) by a pressured region between the heating roller 61 and the pressure roller 62. In addition, the fixing device 60 is provided downstream of the transport belt 41 in a paper transport direction thereof, and is used as a downstream side transport unit to transport the paper P supplied from the transport belt 41. The speed to transport the paper in the fixing device 60 is set to slower than the speed at which the transport belt 41 transports the paper.

The paper P onto which the toner image is transferred in the paper transport device 40 is transported to the fixing device 60 via a transport guide in a state in which the toner image is not fixed. The paper P transported to the fixing device 60 passes through the nip portion (fixing region) formed by the pair of heating roller 61 and pressure roller 62, with the consequence that the toner image is fixed on the paper P by action such as pressing and heating. The paper P on which the fixed toner image is formed is guided by the transport guide and discharged from a pair of discharge rollers 63 to the discharge tray 1*a* of the upper surface of the image forming apparatus 1.

(2) Configuration and Operation of Paper Transport Device

Hereinafter, the configuration and the paper transport operation of the paper transport device 40 according to the exemplary embodiment will be described with reference to the drawings. However, it will be first described with respect to problems of an image forming apparatus 100 according to a comparative example with reference to the drawings.

In the following description, the common components in the paper transport device are respectively denoted by the same reference numerals and a detailed description thereof is omitted.

Image Forming Apparatus of Comparative Example

Figure 6:
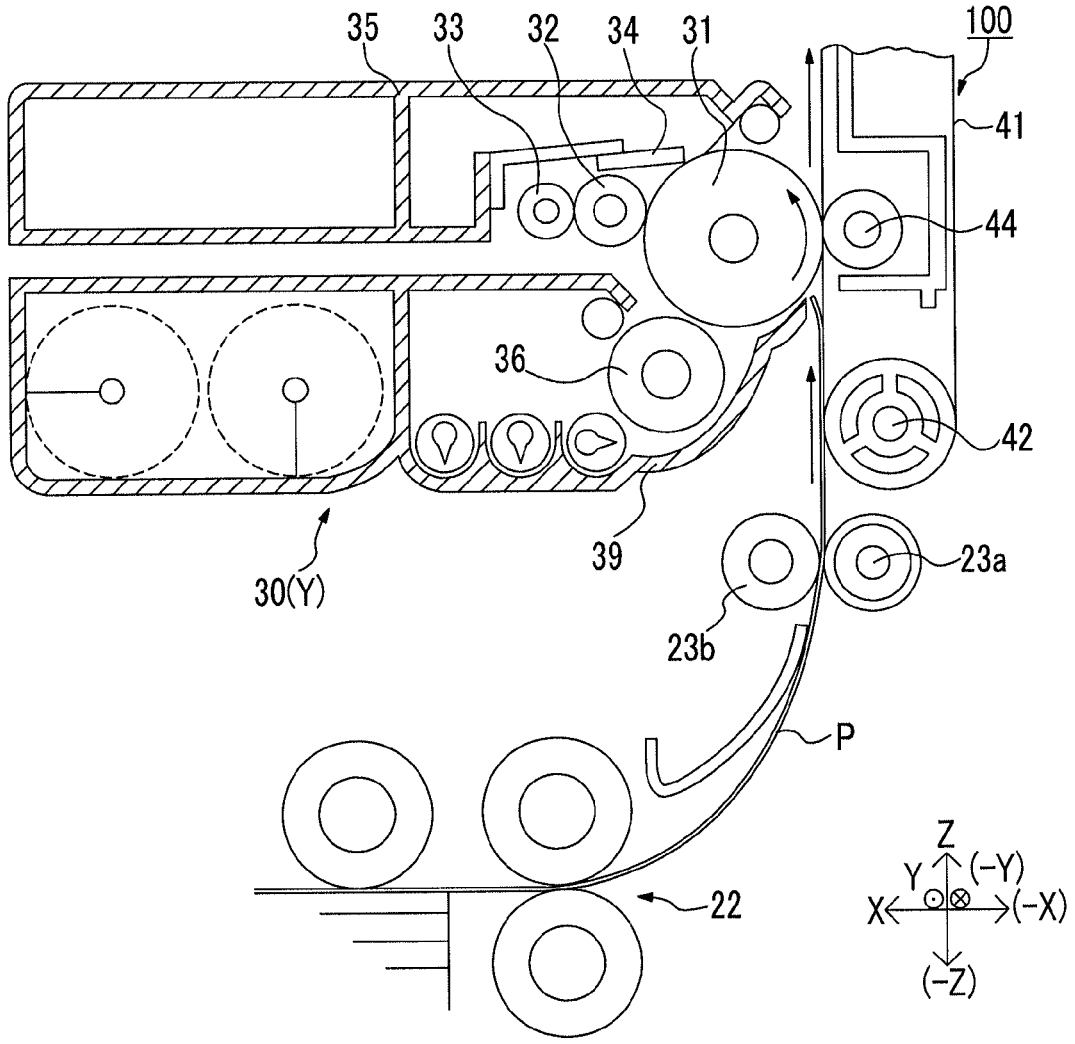
FIG. 6 is a schematic cross-sectional view partially illustrating principal parts of a paper feed device, a paper transport device, and one image forming unit which constitute a paper transport path of an image forming apparatus according to a comparative example.

FIG. 6 is a schematic cross-sectional view partially illustrating principal parts of a paper feed device 20, a paper transport device 40, and one image forming unit 30 which constitute a paper transport path of an image forming apparatus 100 according to a comparative example.

A pair of resist rollers 23 is provided at the downstream side of a paper drawing portion 22. The pair of resist rollers 23 gives a transport force to paper P drawn in the forward direction (−X direction) by the paper drawing portion 22, and is used as a supply unit to supply the paper P to a transport belt 41. The pair of resist rollers 23 has a driving side resist roller 23*a* and a driven side resist roller 23*b*.

The driving side resist roller 23*a* and the driven side resist roller 23*b* come into contact with each other to form a nip portion, and thus a leading edge portion of the paper P, which is drawn from the paper drawing portion 22 and to which the transport force is given, is temporarily stopped by the nip portion. In a temporarily stopped state, the paper P is formed with a predetermined loop and the leading edge portion is pressured, and thereby the skew of a sheet is corrected.

The driving side resist roller 23*a* is connected with a driving source (not shown) through an electromagnetic clutch (not shown) which is used as a release unit to release the transport force to the paper P from the pair of resist rollers 23.

After the paper P is temporarily stopped, the electromagnetic clutch turns ON at a predetermined timing and a rotational driving is transferred from the driving source. Thereby, the driving side resist roller 23*a* supplies the paper P, which is supplied from the paper drawing portion 22, to a nip portion between the transport belt 41 and the image forming unit 30(Y) of the furthest upstream side at a predetermined timing. Meanwhile, the driven side resist roller 23*b* rotates depending on driving of the driving side resist roller 23*a*.

The paper P sent out from the pair of resist rollers 23 is rushed from the furthest upstream end (tension roller 42 side) of the transport belt 41 to the paper feed device 40 and transported to the nip portion between the transport belt 41 and the image forming unit 30Y of the furthest upstream side.

In this case, for thick paper, when the leading edge portion of the paper P is lifted from a surface of the transport belt 41 due to resilience of the paper P and a lifted amount is large, there is a problem in that the leading edge portion of the paper P comes into contact with each toner image before transfer which is retained on a photoconductor drum 31 and toner contamination is generated at the leading edge portion of the paper.

In addition, there is a case of performing a so-called borderless print which prints an image until reaching an edge portion of the paper P without provision of a margin portion throughout the periphery of the edge portion of the paper P.

Figure 5A:
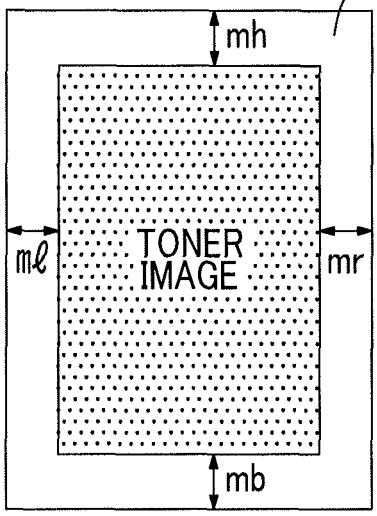
FIG. 5A is a diagram illustrating a bordered print.
Figure 5B:
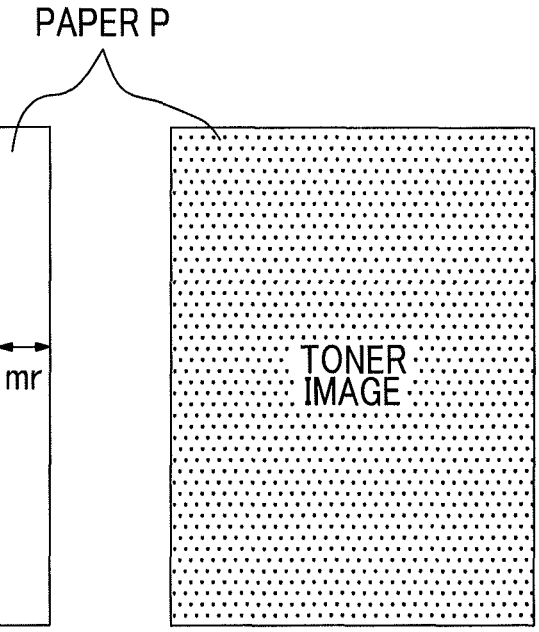
FIG. 5B is a diagram illustrating a borderless print.

FIG. 5A illustrates a bordered print (hereinafter, referred to as a normal print), and FIG. 5B illustrates a borderless print. During the bordered print, the toner image is entirely settled in the paper P and a peripheral margin, such as an upper margin (mh), a lower margin (mb), a left margin (ml), and a right margin (mr), exists around the paper P.

In contrast, during the borderless print, the toner image reaches up to the edge portion of the paper P and the peripheral margin disappears. Although FIG. 5B illustrates a state in which none of an upper margin, a lower margin, a left margin, and a right margin are, the borderless print, which does not have the margin at a portion of the edge portion, for example, does not have the only upper and lower margins, is also performed. In a case of performing such a borderless print, there is a problem in that the leading edge portion of the paper P comes into contact with the toner image before transfer which is retained on the photoconductor drum 31 and image omission is generated at the leading edge portion.

Image Forming Apparatus of Exemplary Embodiment

Figure 2:
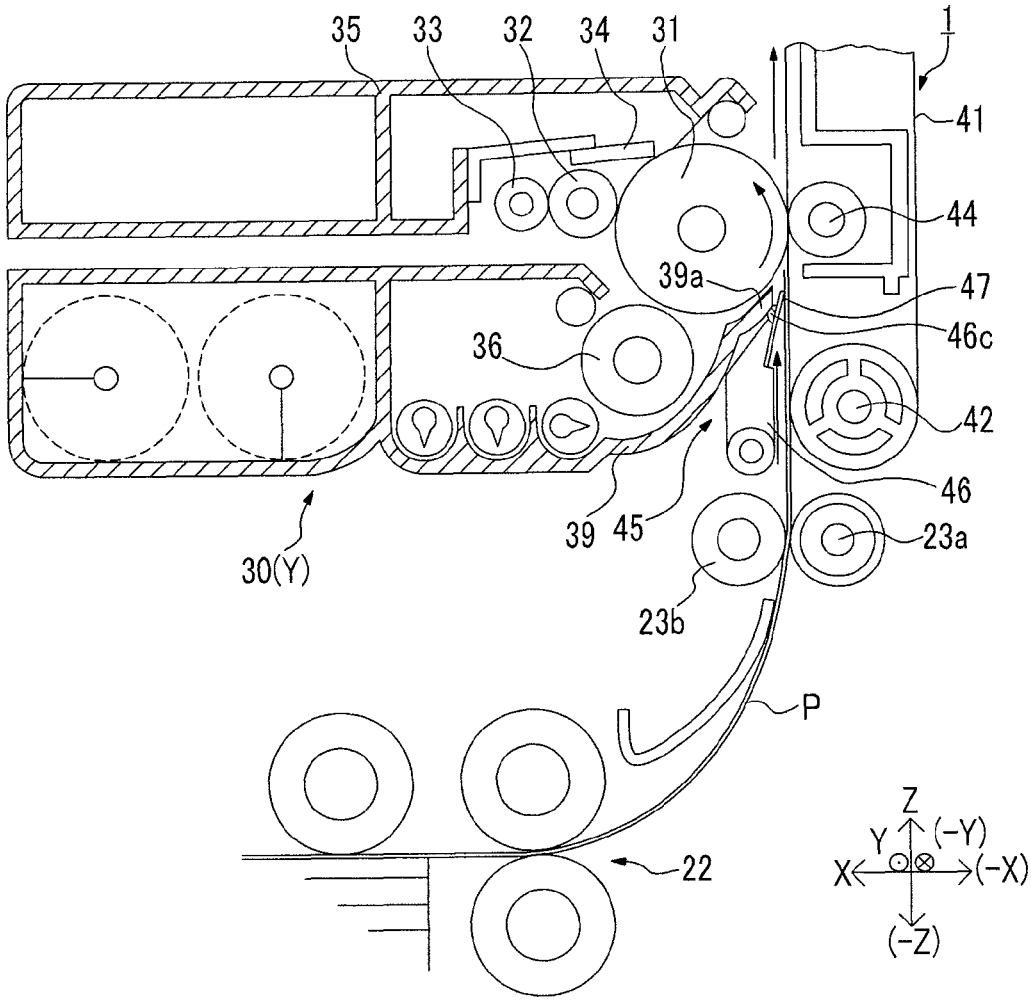
FIG. 2 is a schematic cross-sectional view partially illustrating principal parts of a paper feed device, a paper transport device, and one image forming unit which constitute a paper transport path of the image forming apparatus.

FIG. 2 is a schematic cross-sectional view partially illustrating principal parts of the paper feed device 20, the paper transport device 40, and one image forming unit 30 which constitute the paper transport path of the image forming apparatus 1 according to the exemplary embodiment.

Figure 3A:
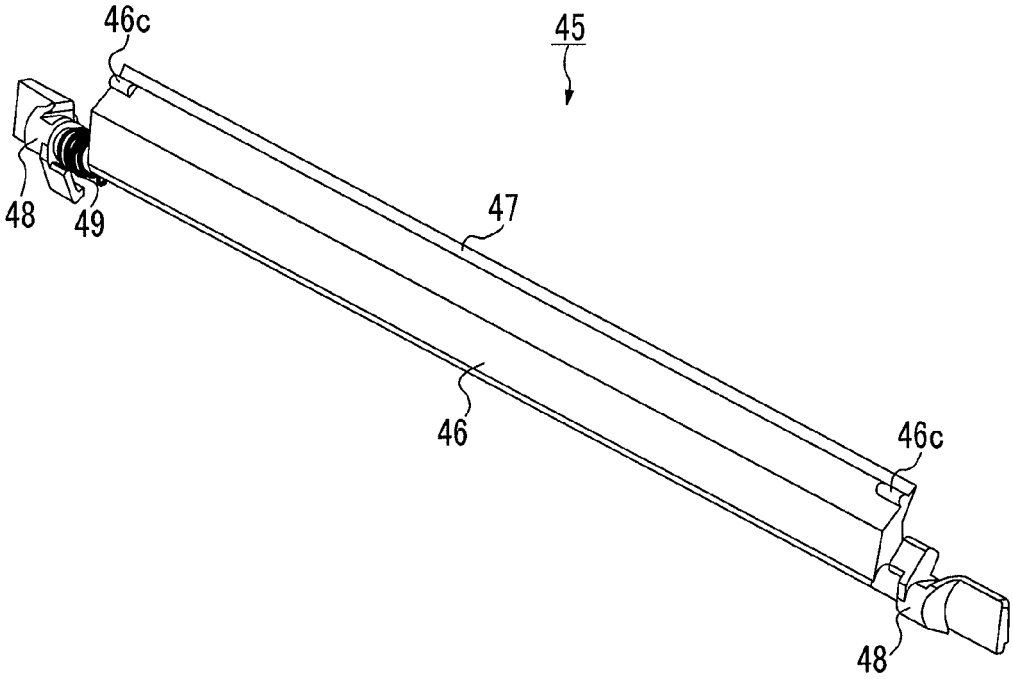
FIG. 3A is a perspective view illustrating a paper posture regulating member when viewed from the surface side thereof.
Figure 3B:
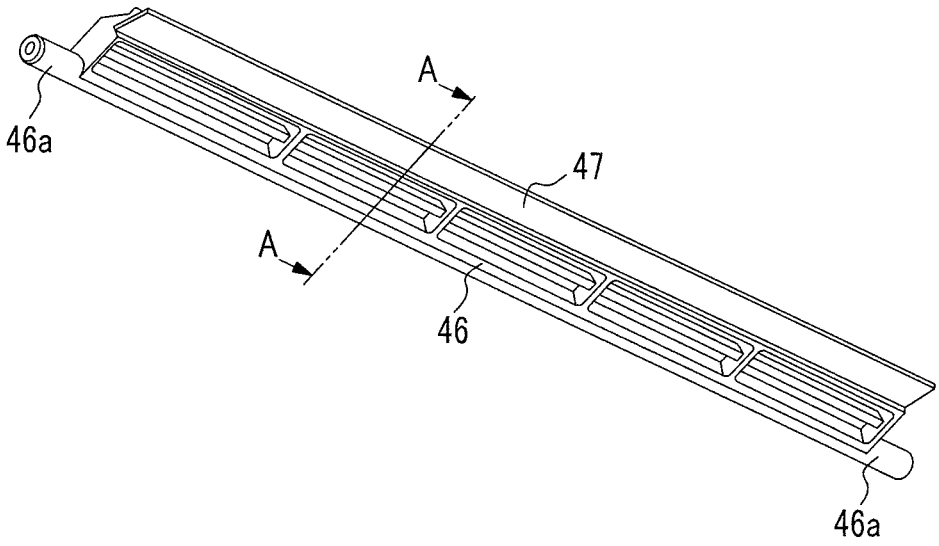
FIG. 3B is a perspective view illustrating a member holder portion and a film member which constitute the paper posture regulating member when viewed from the back surface sides of the member holder portion and the film member.
Figure 3C:
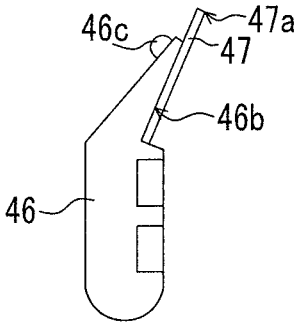
FIG. 3C is a longitudinal cross-sectional view, about cross-section A-A shown in FIG. 3B, schematically illustrating the paper posture regulating member.

FIG. 3A is a perspective view illustrating the paper posture regulating member 45 when viewed from the surface side thereof, FIG. 3B is a perspective view illustrating a member holder portion and a film member which constitute the paper posture regulating member 45 when viewed from the back surface sides of the member holder portion and the film member, and FIG. 3C is a longitudinal cross-sectional view schematically illustrating the paper posture regulating member 45.

The paper transport device 40 of the image forming apparatus 1 according to the exemplary embodiment includes the paper posture regulating member 45 to regulate the paper P, which is transported from the pair of resist rollers 23 at the upstream side of a nip portion between the transport belt 41 and the image forming unit 30(Y) of the furthest upstream side, being lifted from the transport belt 41.

As shown in FIGS. 3A and 3B, the paper posture regulating member 45 includes a member holder portion 46, a film member 47 which comes into contact with the paper P at a leading edge portion thereof to regulate a transport posture of the paper P, bearings 48 to pivotably support shaft portions 46*a* formed at opposite side ends of the member holder portion 46, and spring members 49 to urge the member holder portion 46 and the film member 47 in a direction of being spaced apart from the upper surface side of the transport belt 41.

As shown in FIGS. 3B and 3C, the member holder portion 46 is formed so that a planar portion 46*b*, to which the film member 47 is affixed at a front end side (paper transport downstream side) of the member holder portion 46, extends in a width direction (a direction perpendicular to the transport direction; Y direction) of the paper P.

Each of the shaft portions 46*a*, which is an entire pivot center of the paper posture regulating member 45, is integrally formed at a rear end side (paper transport upstream side) of the member holder portion.

In addition, protrusion portions 46*c* are formed at opposite sides of the surface of the front end side (paper transport downstream side) of the member holder portion which faces a leading edge portion of the development housing 39 of the image forming unit 30(Y) of the furthest upstream side. The member holder portion 46 may be integrally formed using, for example, a synthetic resin.

The film member 47 is made of an elastic material and formed to face the upper surface of the transport belt 41 while making a predetermined angle therewith. For this reason, the paper leading edge when the leading edge of the paper P passes through an edge 47*a* of the film member 47 of the paper transport direction downstream side is in linear contact while making a predetermined angle with the film member 47, and the paper P is transported without being in surface contact with the planar portion of the film member 47.

Specifically, the film member 47 may be made of a PET (polyethylene terephthalate) sheet having a thickness of approximately 0.1 mm to 0.2 mm. That is, when the leading edge of the paper P is rushed into a gap defined between the upper surface of the transport belt 41 and the edge 47*a* of the film member 47, an impact occurring when coming into contact with the film member 47 is relieved and bending or curvature of the paper leading edge is prevented since the film member 47 has elasticity due to the thickness of approximately 0.1 mm to 0.2 mm.

In addition, since PET has high wear resistance, there is no case where the gap is enlarged due to wear even when the paper P is transported while the upper surface of the paper P comes into contact with the edge 47*a* of the film member. Furthermore, there is no case where an applied transfer bias voltage is leaked at a transfer nip portion to cause deterioration of transfer properties by insulating properties.

The bearings 48 support both side ends of the shaft portions 46*a* formed at the rear end side (paper transport upstream side) of the member holder portion 46 so as to be pivotable around central axes of the shaft portions.

Specifically, the bearings 48 are attached to a side frame constituting a housing of the paper transport device 40, and pivotably support the member holder portion 46 and the film member 47 by the spring members 49 so that the member holder portion 46 and the film member 47 are urged with respect to the side frame in the direction of being spaced apart from the upper surface side of the transport belt 41.

Figure 4:
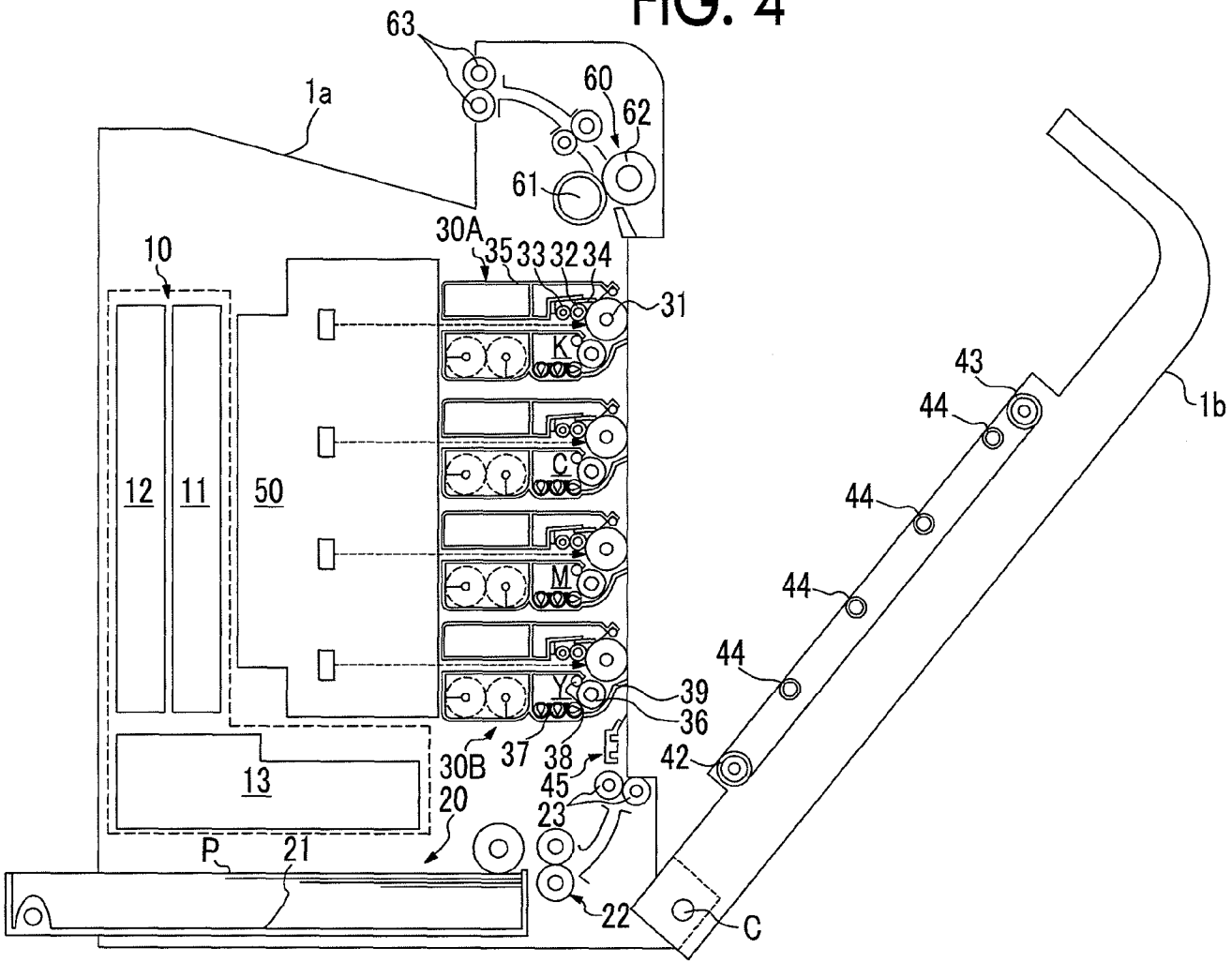
FIG. 4 is a schematic cross-sectional view illustrating a state in which an opening and closing cover is opened with respect to an image forming apparatus member.

In addition, an opening and closing cover (opening and closing unit) 1*b* is provided at a front surface of the image forming apparatus 1. As shown in FIG. 4, the opening and closing cover 1*b* is rotatable (openable and closable) about a pivot C provided at a lower portion of the front surface of the image forming apparatus 1, with respect to an image forming apparatus 1 member.

The paper transport device 40 including the paper posture regulating member 45 is connected to the opening and closing cover 1*b*, thereby moving by opening or closing the opening and closing cover 1*b* and coming into contact with or being separated from each image forming unit 30. In a state of closing the opening and closing cover 1*b*, the paper transport device 40 is positioned to face the image forming unit 30 in a state of being urged toward the image forming unit 30.

When the paper transport device 40 is positioned to face the image forming unit 30 in a state of being urged toward the image forming unit 30, the protrusion portions 46*c* of the member holder portion 46 of the paper posture regulating member 45 come into contact with the leading edge portion 39*a* of the development housing 39 of the image forming unit 30(Y) and the paper posture regulating member 45 is positioned to face the transport belt 41.

The paper posture regulating member 45 retains a preset gap defined between the edge 47*a* of the film member 47 and the upper surface of the transport belt 41 in a state of being positioned so that the protrusion portions 46*c* come into contact with the leading edge portion 39*a* of the development housing 39 of the image forming unit 30(Y).

If the edge 47*a* of the film member 47 is operated in a state of being always in contact with the surface of the transport belt 41 which rotates and moves, there is a problem in that the surface of the transport belt 41 and the edge 47*a* of the film member 47 are worn or the paper P peels off from the film member 47 during transport of the thin paper.

Therefore, it is positioned to retain the gap of approximately 0.3 mm to 1.0 mm, preferably approximately 0.3 mm to 0.7 mm.

Since the paper posture regulating member 45 is positioned to face the transport belt 41 while the protrusion portions 46*c* of the member holder portion 46 come into contact with the leading edge portion 39*a* of the development housing 39 of the image forming unit 30(Y), the related gap is retained with good precision.

In addition, even when the image forming unit 30(Y) is exchanged or attached and detached, the image forming unit 30(Y) is positioned so that the protrusion portions 46*c* of the member holder portion 46 come into contact with the leading edge portion 39*a* of the development housing 39 of the image forming unit 30(Y). Accordingly, the related gap is retained with good precision regardless of the usage conditions of the image forming apparatus 1.

Since the paper posture regulating member 45 is urged in the direction of being spaced apart from the upper surface side of the transport belt 41 by the spring members 49 in a state in which the opening and closing cover 1*b* is opened, the paper posture regulating member 45 is spaced apart from the upper surface side of the transport belt 41 around the central axes of the shaft portions 46*a* supported by the bearings 48.

Accordingly, for example, in a case where paper blockage (paper jam) or the like is generated to thereby remove the jam by opening the opening and closing cover 1*b*, since the paper posture regulating member 45 is spaced apart from the upper surface side of the transport belt 41 by the spring members 49, the jam is easily removed and the film member 47 is not damaged by the removed paper P.

(3) Operation and Effect of Image Forming Apparatus and Paper Transport Device

In the image forming apparatus 1 according to the exemplary embodiment, in a case where a borderless print mode is selected, even when the paper P is supplied in a state of being slightly distorted in all directions, the size of the toner image on the photoconductor drum 31 is formed slightly larger than the size of the selected paper so that margins are not generated at the paper P.

The paper P sent out from the pair of resist rollers 23 is transported from the furthest upstream end (tension roller 42 side) of the transport belt 41 to the paper feed device 40, and enters the gap defined between the film member 47 of the paper posture regulating member 45 and the upper surface of the transport belt 41.

In this case, for the thick paper, the leading edge portion of the paper P is lifted from the surface of the transport belt 41 due to resilience of the paper P, but the lifting of the paper leading edge is regulated by the edge 47*a* of the film member 47 of the paper posture regulating member 45. Therefore, the toner image of the upstream side of the transfer nip portion does not come into contact with the surface of the carried photoconductor drum 31 and the paper leading edge is transported to the nip portion between the transport belt 41 and the image forming unit 30(Y) of the furthest upstream side, and thereby the toner image is transferred from the leading edge of the paper P without being omitted.

The gap between the edge 47*a* of the film member 47 and the upper surface of the transport belt 41 has approximately 0.3 mm to 1.0 mm, preferably approximately 0.3 mm to 0.7 mm. Consequently, the lifting of the leading edge of the thick paper is regulated, and the thin paper does not peel off by the related gap.

In addition, since the paper posture regulating member 45 is positioned so that the protrusion portions 46*c* come into contact with the leading edge portion of the development housing 39 of the image forming unit 30(Y), the related gap is retained with good precision.

The film member 47 is made of the PET (polyethylene terephthalate) sheet having the thickness of approximately 0.1 mm to 0.2 mm. Therefore, when the leading edge of the paper P is rushed into the gap defined between the upper surface of the transport belt 41 and the edge 47*a* of the film member 47, an impact occurring when coming into contact with the film member 47 is relieved and bending or curvature of the paper leading edge is prevented.

In addition, when the paper passes through the gap defined between the film member 47 and the upper surface of the transport belt 41 and the toner image of each color is transferred at the nip portion between the transport belt 41 and each of the image forming units 30, there is no case where an applied transfer bias voltage is leaked at the transfer nip portion to cause deterioration of transfer properties.

In a case where paper blockage (paper jam) or the like is generated, the jam is removed by opening the opening and closing cover 1*b*. In this case, since the paper posture regulating member 45 is rotated and spaced apart from the upper surface side of the transport belt 41 by the spring members 49, the jam is easily removed and the film member 47 is not damaged by the removed paper P.

Although the exemplary embodiment of the present invention has been described above, the invention is not limited thereto. Various modifications may be made without departing from the spirit or scope of the invention described in the following claims.

Although the image forming apparatus 1 according to the exemplary embodiment has been described as a so-called tandem type color image forming apparatus, the invention is not limited thereto. If the image forming apparatus includes a transport belt which performs transfer and transport of toner images to paper sent out from a paper feed device, the above method may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming apparatus member;

a toner image forming unit including a housing that accommodates at least one of a toner image retainer to retain a toner image and a toner retainer to supply a toner to the toner image retainer; and a recording medium transport unit including:

a transport belt, having an endless shape, that is openably and closably mounted to the image forming apparatus member and transports a recording medium, with being wound between a pair of support rollers provided along a transport direction of the recording medium, and a regulation member that faces the transport belt to regulate a posture of the recording medium, the regulation member comprising a projection that contacts a leading edge of the housing, wherein when the recording medium transport unit is closed with respect to the image farming apparatus member, the regulation member is positioned to come into contact with the housing.

2. The image forming apparatus according to claim 1, wherein when the recording medium transport unit is closed with respect to the image forming apparatus member, the regulation member is positioned to have a gap with respect to a surface side on which the recording medium on the transport belt is transported.

3. The image forming apparatus according to claim 2, wherein the regulation member is pivotably assembled with respect to a surface side on which the recording medium on the transport belt is transported, and is urged so as to enlarge a gap when the recording medium transport unit is opened with respect to the image forming apparatus member.

4. The image forming apparatus according to claim 3, wherein the regulation member has a leading edge portion made of an elastomer to face the surface side on which the recording medium on the transport belt is transported.

5. The image forming apparatus according to claim 2, wherein the regulation member has a leading edge portion made of an elastomer to face the surface side on which the recording medium on the transport belt is transported.

6. The image forming apparatus according to claim 1, wherein the regulation member has a leading edge portion made of an elastomer to face a surface side on which the recording medium on the transport belt is transported.

7. A transport device comprising:

a transport belt, having an endless shape, that transports a recording medium, with being wound between a pair of support rollers provided along a transport direction of the recording medium; and a regulation member that faces the transport belt to regulate a posture of the recording medium, the regulation member comprising a projection that contacts a leading edge of a housing, wherein the transport device is openably and closably mounted to face a toner image forming unit including the housing that accommodates at least one of a toner image retainer to retain a toner image and a toner retainer to supply a toner to the toner image retainer, and wherein the regulation member is positioned to come into contact with the housing when being closed to face the toner image forming unit.

* * * * *